US008629665B2

(12) United States Patent
Tsai et al.

(10) Patent No.: US 8,629,665 B2
(45) Date of Patent: Jan. 14, 2014

(54) VOLTAGE REGULATING APPARATUS

(75) Inventors: Tsung-Yen Tsai, Hsinchu County (TW); Ying Hsi Lin, Hsinchu (TW)

(73) Assignee: Realtek Semiconductor Corp., Hsinchu (TW)

( * ) Notice: Subject to any disclaimer, the term of this patent is extended or adjusted under 35 U.S.C. 154(b) by 201 days.

(21) Appl. No.: 13/293,601

(22) Filed: Nov. 10, 2011

(65) Prior Publication Data

US 2012/0223685 A1 Sep. 6, 2012

(30) Foreign Application Priority Data

Mar. 4, 2011 (TW) ..... 100107434 A

(51) Int. Cl.
*G05F 1/00* (2006.01)

(52) U.S. Cl.
USPC ..... 323/269; 323/272

(58) Field of Classification Search
USPC ..... 323/268, 269, 272
See application file for complete search history.

(56) References Cited

U.S. PATENT DOCUMENTS

| | | | | |
|---|---|---|---|---|
| 6,737,839 | B2 * | 5/2004 | Hiraki et al. | 323/268 |
| 7,064,531 | B1 | 6/2006 | Zinn | |
| 7,759,916 | B2 * | 7/2010 | Kleveland | 323/268 |
| 7,763,994 | B2 * | 7/2010 | Inomoto | 307/75 |
| 2007/0290657 | A1 * | 12/2007 | Cretella et al. | 323/222 |

* cited by examiner

*Primary Examiner* — Jue Zhang
(74) *Attorney, Agent, or Firm* — Morris Manning & Martin LLP; Tim Tingkang Xia, Esq.

(57) ABSTRACT

The invention discloses a voltage regulating apparatus, which includes: a linear regulator generating a first error signal; a switching regulator generating a first and a second PWM signals; a selecting unit coupled to the linear and switching regulators, receiving the first error signal and the second PWM signal, and outputting a regulating signal; a first power transistor coupled to the switching regulator and receiving the first PWM signal; and a second power transistor coupled to the selecting unit and receiving the regulating signal; wherein the voltage regulating apparatus can be put either in a linear mode of operation if the first error signal is selected as the regulating signal, or in a switching mode of operation if the second PWM signal is selected as the regulating signal.

13 Claims, 5 Drawing Sheets

VOLTAGE REGULATING APPARATUS

CROSS-REFERENCE TO RELATED APPLICATIONS

This non-provisional application claims priority under 35 U.S.C. §119(a) on Patent Application No. 100107434 filed in Taiwan (R.O.C.) on Mar. 4, 2011, the entire contents of which are hereby incorporated by reference.

TECHNICAL FIELD

The present disclosure relates to a voltage regulating apparatus, and more particularly, to a switching-mode voltage regulating apparatus which can also operate in a linear mode.

TECHNICAL BACKGROUND

Voltage regulators are used to automatically regulate an irregular voltage to a DC voltage of constant level. Generally, the voltage regulators can be classified into two operational modes: linear and switching modes. The linear-mode voltage regulator mainly includes an LDO (Low-dropout) regulator, while the switching-mode voltage regulator mainly includes a PWM (Pulse-width-modulation) regulator. A linear-mode voltage regulator usually provides a less output current, which is applicable to the usage of light load or no load, preferably to the light load. Instead, a switching-mode voltage regulator usually provides a larger output current, which is applicable to the usage of heavy load.

Voltage regulators operable in both linear and switching operational modes have been developed recently, in order to lower the fabrication cost in consideration of mess-production. An individual integrated-circuit (IC) chip of voltage regulator with both modes may be applicable to various user requirements. However, more electrical components would be included in the circuit layout of such a voltage regulator. The number of components needs to be decreased to lower the cost without degrading its operational performance.

TECHNICAL SUMMARY

According to one aspect of the present disclosure, a first embodiment provides a voltage regulating apparatus comprising a linear regulation unit, a switching regulation unit, a selection unit, and first and second power transistors. Wherein, the linear regulation unit comprises a first output stage providing the voltage regulating apparatus with a first output voltage and producing a first partial voltage which is a fraction of the first output voltage, and a first error amplifier coupled to the first output stage and comparing the first partial voltage with a first reference voltage to produce a first error signal; the switching regulation unit comprises a second output stage providing the voltage regulating apparatus with a second output voltage and producing a second partial voltage which is a fraction of the second output voltage, and a PWM unit coupled to the second output stage and producing first and second PWM signals according to the second partial voltage and a second reference voltage; the selection unit is coupled to the linear and switching regulation units, receives the first error signal and the second PWM signal, and outputs a regulating signal which is selected from one of the first error signal and the second PWM signal; the first power transistor is coupled to the switching regulation unit to receive the first PWM signal; and the second power transistor is coupled to a bonding pad, the first power transistor, and the selection unit to receive the regulating signal. Wherein, a connection point of the first and second power transistors is connected to the second output stage, and wherein the voltage regulating apparatus can be put either in a linear mode of operation if the first error signal is selected as the regulating signal and the bonding pad is connected to the first output stage, or in a switching mode of operation if the second PWM signal is selected as the regulating signal and the bonding pad is connected to a ground.

According to another aspect of the present disclosure, a second embodiment provides a voltage regulating apparatus comprising a linear regulation unit, a switching regulation unit, a selection unit, and first and second power transistors. Wherein, the linear regulation unit comprises a first output stage providing the voltage regulating apparatus with a first output voltage and producing a first partial voltage which is a fraction of the first output voltage, and a first error amplifier coupled to the first output stage and comparing the first partial voltage with a first reference voltage to produce a first error signal; the switching regulation unit comprises a second output stage providing the voltage regulating apparatus with a second output voltage and producing a second partial voltage which is a fraction of the second output voltage, and a PWM unit coupled to the second output stage and producing first and second PWM signals according to the second partial voltage and a second reference voltage; the selection unit is coupled to the linear and switching regulation units, receives the first error signal and the second PWM signal, and outputs a regulating signal which is selected from one of the first error signal and the second PWM signal; the first power transistor is coupled to the switching regulation unit to receive the first PWM signal; and the second power transistor is coupled to a ground switch, the first power transistor, and the selection unit to receive the regulating signal. Wherein, a connection point of the first and second power transistors is connected to the second output stage, a connection point of the ground switch and the second power transistor is connected to the first output stage, and the voltage regulating apparatus can be put either in a linear mode of operation if the first error signal is selected as the regulating signal and the ground switch is turned off, or in a switching mode of operation if the second PWM signal is selected as the regulating signal and the ground switch is turned on.

Further scope of applicability of the present application will become more apparent from the detailed description given hereinafter. However, it should be understood that the detailed description and specific examples, while indicating exemplary embodiments of the disclosure, are given by way of illustration only, since various changes and modifications within the spirit and scope of the disclosure will become apparent to those skilled in the art from this detailed description.

BRIEF DESCRIPTION OF THE DRAWINGS

The present disclosure will become more fully understood from the detailed description given herein below and the accompanying drawings which are given by way of illustration only, and thus are not limitative of the present disclosure and wherein.

DESCRIPTION OF THE EXEMPLARY EMBODIMENTS

For further understanding and recognizing the fulfilled functions and structural characteristics of the disclosure, several exemplary embodiments cooperating with detailed description are presented as the following.

Figure 1:
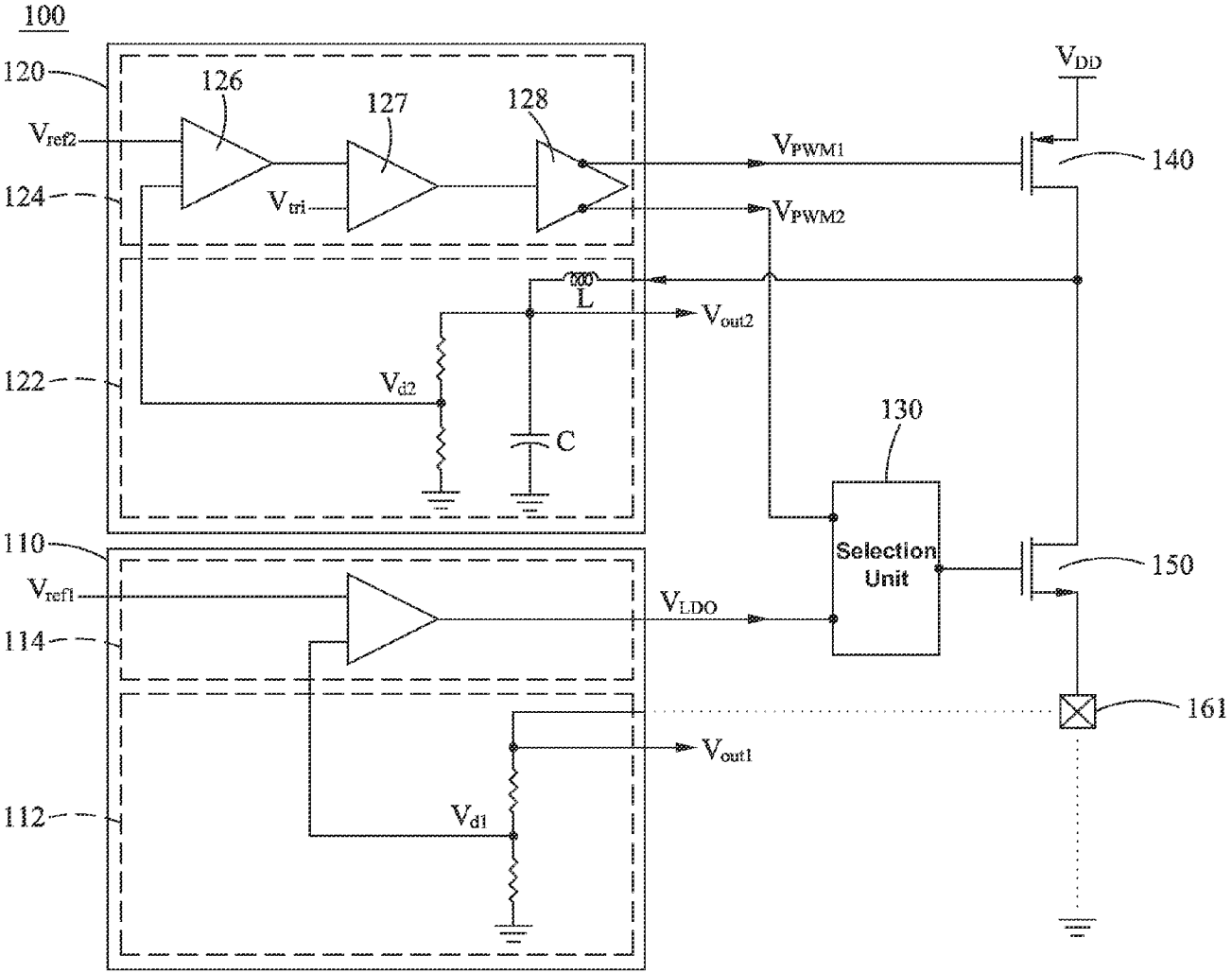
FIG. 1 is a circuit diagram illustrating a voltage regulating apparatus according to a first embodiment of the present invention.

FIG. 1 shows a circuit diagram illustrating a voltage regulating apparatus according to a first embodiment of the present invention. As shown in FIG. 1, the voltage regulating apparatus 100 includes a linear regulation unit 110, a switching regulation unit 120, a selection unit 130, and at least two power transistors 140 and 150. Basically, the voltage regulating apparatus 100 can function as a voltage regulator of switching operational mode, but it can also provide a linear mode of regulating operation, depending predetermined conditions or practical necessities. In the embodiment, the power transistors are shared by both the linear and switching operation of voltage regulation; furthermore, no discrete capacitor is required to be mounted therein additionally, so that its cost can be lowered while its applicability can be extended.

The linear regulation unit 110 includes a first output stage 112 and a first error amplifier 114. In the embodiment, the first output stage 112 can provide the voltage regulating apparatus 100 with a first output voltage $V_{out1}$. The first output stage 112 includes a first voltage divider which is composed of a plurality of resistances in series connection. The voltage divider can produce a first partial voltage $V_{d1}$ which is a fraction of the output voltage $V_{out1}$ according to the resistive division of voltage, so as to be provided as an input voltage of the first error amplifier 114. The first error amplifier 114 is coupled to the first output stage 112 to receive the first partial voltage $V_{d1}$ and then compares the first partial voltage $V_{d1}$ with a first reference voltage $V_{ref1}$ to produce a difference signal. The difference signal is further amplified to be a first error signal $V_{LDO}$, so as to support operation of the voltage regulating apparatus 100 in the linear mode.

The switching regulation unit 120 includes a second output stage 122 and a PWM unit 124. In the embodiment, the second output stage 122 can provide the voltage regulating apparatus 100 with a second output voltage $V_{out2}$. The second output stage 122 includes a second voltage divider and a low-pass filter. The second voltage divider can also be composed of a plurality of resistances in series connection, and produce a second partial voltage $V_{d2}$ which is a fraction of the output voltage $V_{out2}$ according to the resistive division of voltage, so as to be provided as an input voltage of the PWM unit 124 for its operation in the switching mode. Also in the embodiment, the low-pass filter is composed of a capacitor C and an inductor L, which can be discrete devices and not integrated into an integrated-circuit (IC) chip of the voltage regulating apparatus 100 itself. The capacitor C and/or the inductor L can be chosen and bonded to an IC chip based on the circuit design and specification. The PWM unit 124 is provided for putting the voltage regulating apparatus 100 in the switching mode of operation. As shown in FIG. 1, the PWM unit 124 can be formed by sequentially connecting a second error amplifier 126, a comparator 127, and a pre-driver 128 in series. The second error amplifier 126 is connected to the second output stage 124, and compares the second partial voltage $V_{d2}$ with a second reference voltage $V_{ref2}$ to produce a difference signal. The difference signal is further amplified to be a second error signal. The comparator 127 is connected to the second error amplifier 126, and can compare the second error signal with a voltage signal $V_{tri}$ of triangle or sawtooth wave to produce a comparison signal. The pre-driver 128 is connected to the comparator 127, and can amplify the comparison signal to be the first and second PWM signals $V_{PWM1}$ and $V_{PWM2}$ with improved driving capacity, so as to support operation of the voltage regulating apparatus 100 working in the switching mode.

The selection unit 130 is provided for the voltage regulating apparatus 100 to select its operation either in the linear mode or in the switching mode. The selection unit 130 is coupled to the linear regulation unit 110 and the switching regulation unit 120 to receive the first error signal $V_{LDO}$ and the second PWM signal $V_{PWM2}$. The selection unit 130 can generate a regulating signal which is selected from one of the first error signal $V_{LDO}$ and the second PWM signal $V_{PWM2}$. In the embodiment, the selection unit 130 can output the first error signal $V_{LDO}$ as the regulating signal if the voltage regulating apparatus is put in the linear mode of operation, while output the second PWM signals $V_{PWM2}$ if the voltage regulating apparatus is put in the switching mode of operation.

Figure 3:
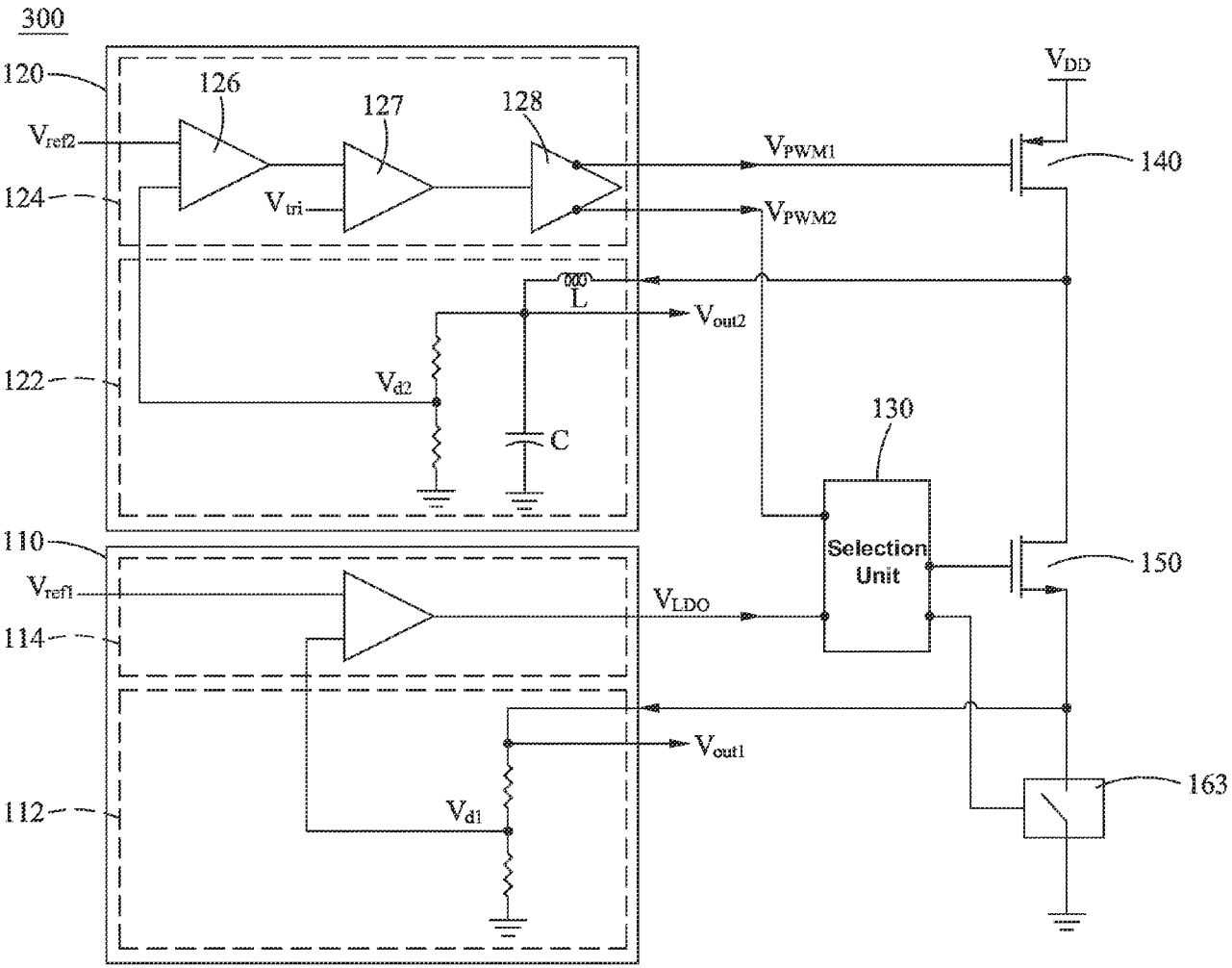
FIG. 3 is a circuit diagram illustrating a voltage regulating apparatus according to a second embodiment of the present invention.

Furthermore, to make the operation of the voltage regulating apparatus switched between the linear and switching modes, a ground switch 163 which is controlled by the selection unit 130 can be further included in another embodiment as illustrated in FIG. 3. The ground switch 163 is connected to the second power transistor 150 and a ground. The detail will be described hereinafter.

Regarding the circuit layout of the voltage regulating apparatus 100 of switching mode, the power transistor can be embodied as a CMOS (complementary metal-oxide-semiconductor) transistor, which is composed of a P-type MOSFET (metal-oxide-semiconductor field-effect) transistor 140 and an N-type MOSFET transistor 150. The P-type MOSFET transistor 140 can have its gate connected to switching regulation unit 120 to receive the first PWM signal $V_{PWM1}$, its source connected to a DC voltage $V_{DD}$, and its drain connected to the N-type MOSFET transistor 150. The N-type MOSFET transistor 150 can have its gate connected to the selection unit 130 to receive the regulating signal and its drain connected to the P-type MOSFET transistor 140.

Figure 2A:
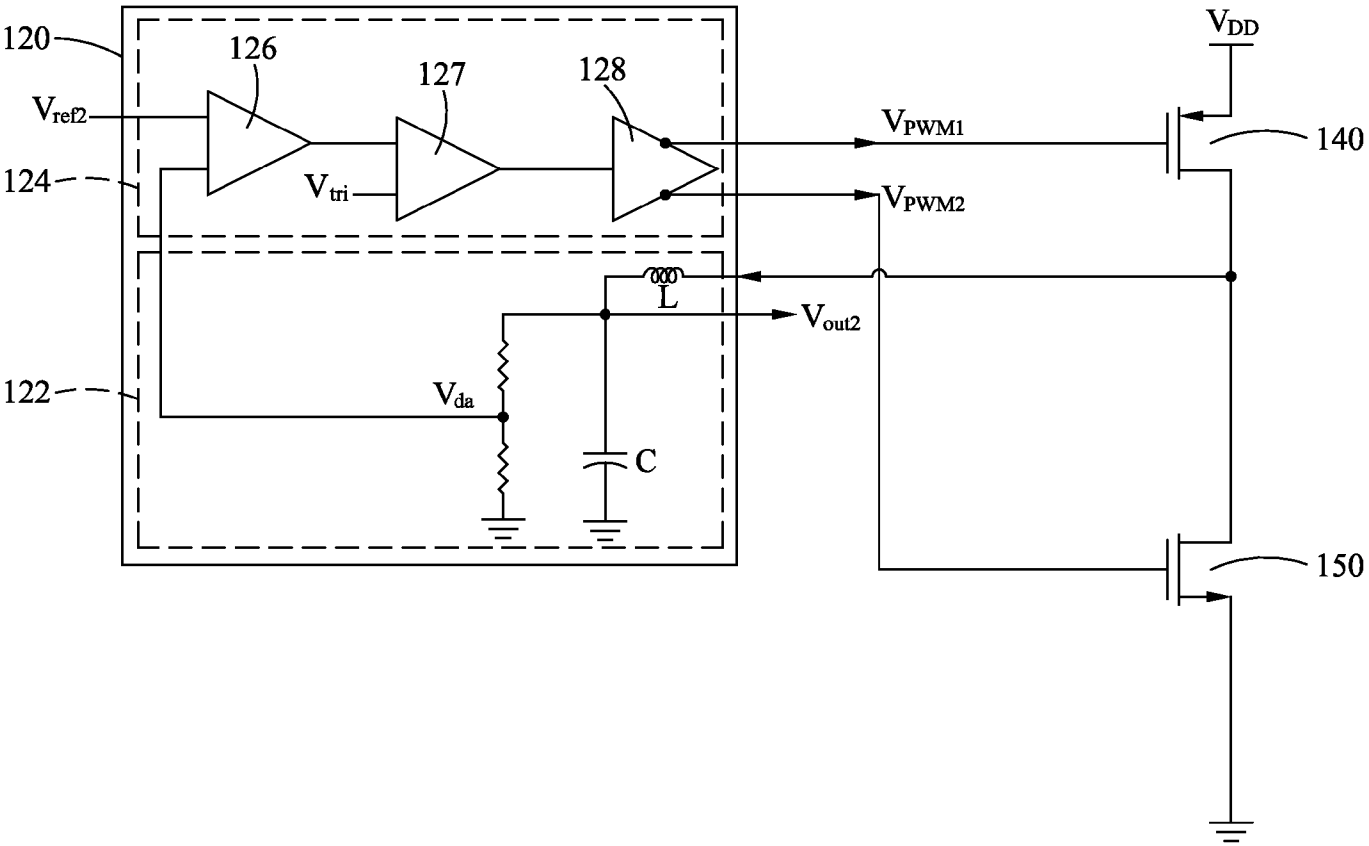
FIG. 2A is an equivalent circuit of the voltage regulating apparatus of FIG. 1 operating in the switching mode.
Figure 2B:
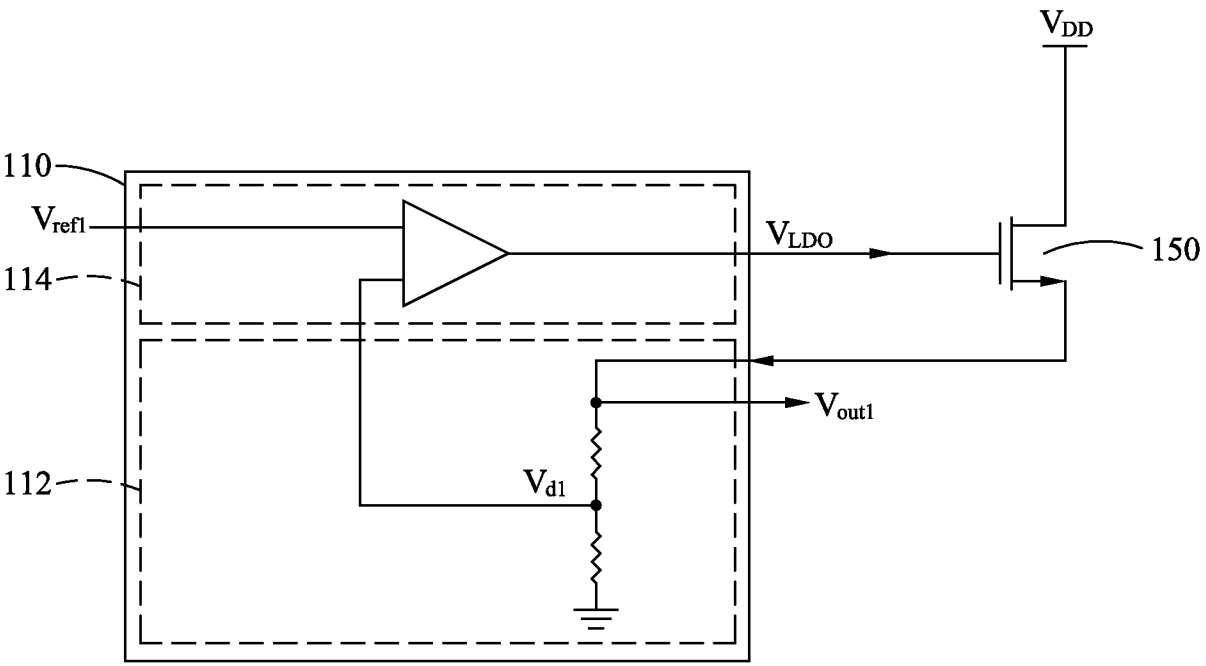
FIG. 2B is an equivalent circuit of the voltage regulating apparatus of FIG. 1 operating in the linear mode.

In the following, the voltage regulating apparatus 100 is embodied in exemplary examples to show its flexibility. The first example of the voltage regulating apparatus 100 is also shown in FIG. 1, where the source of the N-type MOSFET transistor 150 can be connected to one terminal of a bonding pad 161 or a connection pin of a packaged chip of the voltage regulating apparatus. The other terminal of the bonding pad 161 is switched to be connected with one of a ground and the first output stage 112. When the voltage regulating apparatus 100 is put in the switching mode of operation by switching the other terminal of the bonding pad 161 to the ground, the regulating signal can be the second PWM signal $V_{PWM2}$. The diagram of its equivalent circuit can then be illustrated in FIG. 2A, which shows that the voltage regulating apparatus 100 can operate in the switching mode. On the other aspect, when the voltage regulating apparatus 100 is put in the linear mode of operation by switching the other terminal of the bonding pad 161 to the first output stage 112 so as to output the first output voltage $V_{out1}$, the regulating signal can be the first error signal $V_{LDO}$. The diagram of its equivalent circuit can then be illustrated in FIG. 2B, which shows that the voltage regulating apparatus 100 can operate in the linear mode.

The second example is illustrated in FIG. 3, where the voltage regulating apparatus 300 includes a ground switch 163, which can also be controlled by the selection unit 130. One connection terminal of the ground switch 163 is connected to the N-type MOSFET transistor 150, while its other connection terminal is connected to a ground. When the voltage regulating apparatus 300 is put in the switching mode of operation by turning on the ground switch 163 to ground the source of the N-type MOSFET transistor 150, the regulating signal can be the second PWM signal $V_{PWM2}$. The diagram of its equivalent circuit can also be the one in FIG. 2A, where the voltage regulating apparatus 300 operates in the switching mode. On the other aspect, when the voltage regulating apparatus 300 is put in the linear mode of operation by turning off the ground switch 163 to connect the source of the N-type MOSFET transistor 150 with the first output stage 112 so as to output the first output voltage $V_{out1}$, the regulating signal can be the first error signal $V_{LDO}$. The diagram of its equivalent circuit can also be the one in FIG. 2B, which shows that the voltage regulating apparatus 300 operates in the linear mode.

It should be noted that a conventional linear-mode voltage regulator has a P-type MOSFET transistor as the power transistor in its output stage, in which the output resistance may be large and a low-pass filtering capacitor with a capacitance of 1 μF to 10 μF may be mounted on the voltage regulator. On the contrary, in the embodiment, an N-type MOSFET transistor is used to function as the power transistor in the output stage, so the output resistance at its source is smaller and thereby no filtering capacitor is required to be added onto the voltage regulator. Thus, it is more cost-advantageous. Moreover, a linear-mode voltage regulator usually provides a less output current, so it is applicable to the usage of light load or no load, preferably to the light load. Instead, a switching-mode voltage regulator usually provides a larger output current, so it is applicable to the usage of heavy load. In the embodiment, the N-type MOSFET transistor 150 is shared by the voltage regulating apparatus 100 of both the linear and switching modes, but the requirements for operational currents of the N-type MOSFET transistor 150 in the two modes are different from each other. Consequently, the N-type MOSFET transistor 150 can have its operational current be variable. According to the IC design techniques, the N-type MOSFET transistor 150 can be composed of a plurality of N-type transistors in parallel connection. In more detail, sources of the plurality of N-type transistors are connected to each other, gates of the plurality of N-type transistors are connected to each other, and drains of the plurality of N-type transistors are connected to each other. By the parallel connection of the plurality of N-type transistors, the operational current of the N-type MOSFET transistor 150 can be variable depending on the practical situations. Moreover, since the P-type MOSFET transistor 140 is connected in series to the N-type MOSFET transistor 150 including the plurality of N-type transistors in parallel and works only in the switching mode of operation, it may have a larger operational current.

Figure 4:
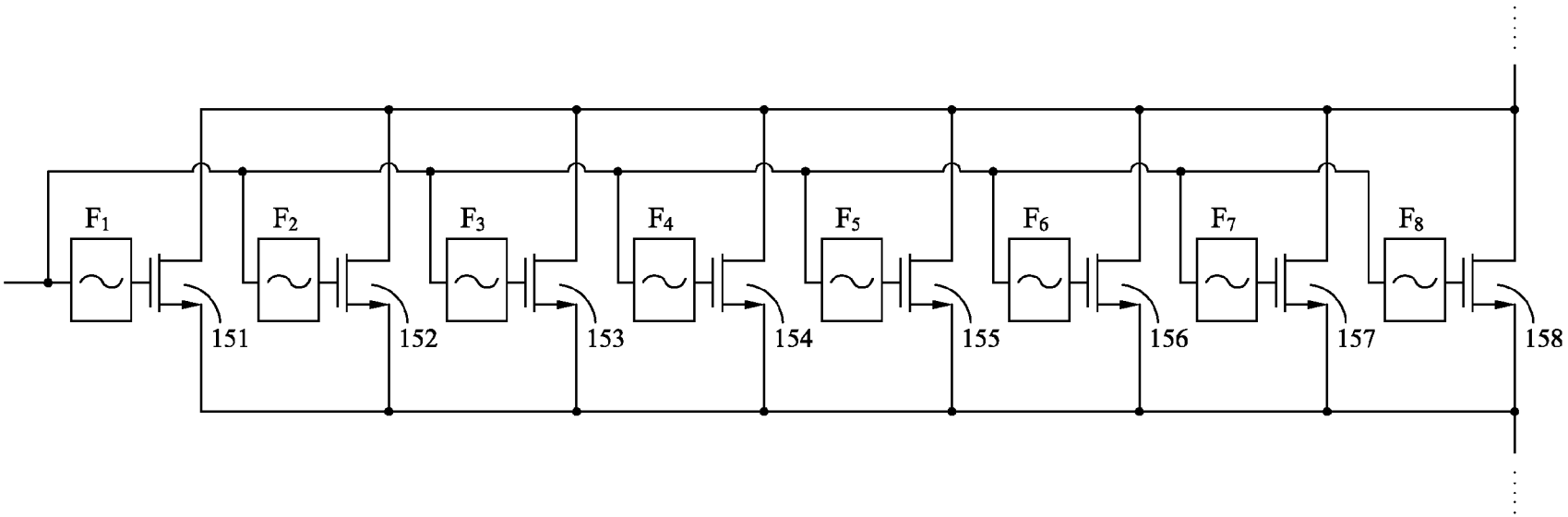
FIG. 4 is a circuit diagram of the N-type MOSFET transistor according to an exemplary embodiment, wherein the N-type MOSFET transistor is composed of eight N-type transistors.

For example, FIG. 4 illustrates a circuit diagram of the N-type MOSFET transistor according to an exemplary embodiment, wherein the N-type MOSFET transistor can be composed of eight N-type transistors 151 to 158, in which their gates are connected to switches $F_1$ to $F_8$, respectively. The other terminal of the each switch $F_1$ to $F_8$ is connected to the selection unit 130 to receive the regulating voltage. In the embodiment, the switches $F_1$ to $F_8$ can be implemented by fuse switches formed by the IC fabrication process. Whereby, a predetermined number of individual N-type transistors are in parallel connection to form the N-type MOSFET transistor 150, so as to provide an enough operational current for the output stage of the voltage regulating apparatus, either in the linear mode or in the switching mode. For example, if it is required for the voltage regulating apparatus to provide a less operational current, the switch $F_1$ can be short-circuited while the switches $S_2$ to $S_8$ is open-circuited to get a less operational current in the N-type MOSFET transistor 150; wherein the voltage regulating apparatus may operate in the linear mode. On the other hand, if it is required for the voltage regulating apparatus to provide a larger operational current, all the switches $F_1$ to $F_8$ can be short-circuited to get a larger operational current in the N-type MOSFET transistor 150; wherein the voltage regulating apparatus may operate in the switching mode. Thus, the N-type MOSFET transistor 150 of the voltage regulating apparatus can be shared in both the linear and switching modes, and, concurrently, no discrete capacitor is required to be mounted therein additionally, so that the fabrication cost can be lowered. But it is not limited thereby; the N-type MOSFET transistor 150 can be the other type of current-variable power transistor.

With respect to the foregoing description, it is to be realized that the optimum dimensional relationships for the parts of the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present disclosure.

What is claimed is:

1. A voltage regulating apparatus comprising:

a linear regulation unit comprising a first output stage providing the voltage regulating apparatus with a first output voltage and producing a first partial voltage which is a fraction of the first output voltage; and a first error amplifier coupled to the first output stage and comparing the first partial voltage with a first reference voltage to produce a first error signal;

a switching regulation unit comprising a second output stage providing the voltage regulating apparatus with a second output voltage and producing a second partial voltage which is a fraction of the second output voltage; and a PWM unit coupled to the second output stage and producing first and second PWM signals according to the second partial voltage and a second reference voltage;

a selection unit coupled to the linear and switching regulation units, receiving the first error signal and the second PWM signal, and outputting a regulating signal which is selected from one of the first error signal and the second PWM signal;

a first power transistor coupled to the switching regulation unit and receiving the first PWM signal; and a second power transistor coupled to both the selection unit and the first power transistor, and receiving the regulating signal;

wherein a connection point of the first and second power transistors is coupled to the second output stage; and wherein the voltage regulating apparatus can be put either in a linear mode of operation if the first error signal is selected as the regulating signal, or in a switching mode of operation if the second PWM signal is selected as the regulating signal.

2. The voltage regulating apparatus of claim 1, further comprising a ground switch coupled to the second power transistor, wherein a connection point of the ground switch and the second power transistor is connected to the first output stage.

3. The voltage regulating apparatus of claim 2, wherein the ground switch is connected to a ground, wherein the ground switch is turned off if the voltage regulating apparatus is put in the linear mode of operation, while is turned on if the voltage regulating apparatus is put in the switching mode of operation.

4. The voltage regulating apparatus of claim 1, further comprising a bonding pad connected to the second power transistor, wherein the bonding pad is further connected to the first output stage if the voltage regulating apparatus is put in the linear mode of operation, while is connected to a ground if the voltage regulating apparatus is put in the switching mode of operation.

5. The voltage regulating apparatus of claim 1, wherein the first power transistor comprises a P-type MOSFET transistor in which its gate is connected to the PWM unit to receive the first PWM signal, its source is connected to a DC voltage, and its drain is connected to the second power transistor.

6. The voltage regulating apparatus of claim 1, wherein the second power transistor has an operational current which is variable.

7. The voltage regulating apparatus of claim 1, wherein the second power transistor comprises a plurality of N-type MOSFET transistors in parallel connection.

8. The voltage regulating apparatus of claim 7, wherein each N-type MOSFET transistor has a gate connected to the selection unit to receive the regulating signal and a drain connected to the first power transistor.

9. The voltage regulating apparatus of claim 1, wherein the PWM unit comprises:

a second error amplifier connected to the second output stage and comparing the second partial voltage with the second reference voltage to produce a second error signal;

a comparator connected to the second error amplifier and comparing the second error signal with a voltage signal to produce a comparison signal; and a pre-driver connected to the comparator, amplifying the comparison signal, and producing the first and second PWM signals.

10. The voltage regulating apparatus of claim 1, wherein the first output stage comprises a first voltage divider composed of a plurality of resistances in series connection.

11. The voltage regulating apparatus of claim 1, wherein the second output stage comprises a second voltage divider and a low-pass filter.

12. The voltage regulating apparatus of claim 11, wherein the second voltage divider composed of a plurality of resistances in series connection.

13. The voltage regulating apparatus of claim 11, wherein the low-pass filter comprises a capacitor and an inductor.

* * * * *